US005182822A

United States Patent [19]

Cyr et al.

[11] Patent Number: 5,182,822

[45] Date of Patent: Feb. 2, 1993

[54] CHILD'S SINK APPARATUS

[76] Inventors: Dwayne L. Cyr, 17-733 Oak La., Lady Lake, Fla. 32159; Dale A. McCollom, 35918 Union Lake Rd. Apt. 106, Mt. Clemens, Mich. 48043

[21] Appl. No.: 682,337

[22] Filed: Apr. 9, 1991

[51] Int. Cl.[5] ..... A47K 1/00

[52] U.S. Cl. ..... 4/625; 4/628; 4/630; 4/638; 446/167; 446/482

[58] Field of Search ..... 4/630, 619, 638, 650, 4/196, 265, 195, 624, 625, 626, 631, 632; 239/4, 12, 17, 16, 29, 29.3, 28, 34, 37, 38, 73, 102.1; 312/602, 228, 43; 446/166, 167, 267, 479, 482; 40/406, 407, 409, 412, 422

[56] References Cited

U.S. PATENT DOCUMENTS 932,054 8/1909 McPherson ..... 312/228 X 4,858,783 8/1989 Mayfield ..... 312/43 X

FOREIGN PATENT DOCUMENTS 1016312 11/1952 France ..... 4/628

*Primary Examiner*—Charles E. Phillips

*Attorney, Agent, or Firm*—Leon Gilden

[57] ABSTRACT

A cabinet structure includes side walls, a floor, and a rear wall, and a top wall mounting a concave sink therewithin. The sink is operative through a manually operative pump and an underlying reservoir to direct fluid into the sink, with a drain associated with the sink directed into a further reservoir. A cylindrical cavity contains a series of nested cylindrical cups therewithin mounted for access in an inverted configuration. A modification of the invention includes a rear plate directed upwardly of a rear wall mounting a further reservoir, wherein the further reservoir includes a serpentine conduit, with the serpentine conduit directing metered fluid onto a simulated toothbrush member to effect oscillation of the toothbrush member, whererin the toothbrush member is biased by a spring to effect oscillation of the toothbrush upon fluid directed upon the toothbrush head.

1 Claim, 5 Drawing Sheets

CHILD'S SINK APPARATUS

BACKGROUND OF THE INVENTION

1. Field of the Invention

The field of invention relates to children's accessory apparatus, and more particularly pertains to a new and improved child's sink apparatus wherein the same provides a sink with a manual pump and reservoir for fluid, with cups mounted therewithin. Description of the Prior Art Various portable wash apparatus is utilized in the Prior art. The portable wash apparatus, as well as apparatus of convenient construction is provided to permit a self-serving type of organization for use in a transportable manner. Such patents are exemplified by U.S. Pat. No. 4,765,003 to Chang utilizing foot controls mounted about the base of the organization for permitting selection of water and directing people to stand in a particular orientation relative to the sink structure.

U.S. Pat. No. 4,130,123 to Wines, Jr., et al. sets forth a portable nursing apparatus utilizing a sink, as well as a heating and water dispensing organization.

U.S. Pat. No. 3,983,583 to Herman, et al. sets forth a portable wet bar utilizing a pump and a waste water receiving reservoir underlying a sink structure.

U.S. Pat. No. 2,786,211 to Culver, Jr. sets forth a self-serving sink utilizing a pump and elongate waste water hose to be connected to a remote fluid accepting reservoir.

U.S. Pat. No. 1,358,937 to Curliss sets forth a housing structure wherein a sink member is hingedly mounted to a support, wherein the support includes a fluid reservoir to direct water into the sink member when the sink member is opened relative to the reservoir.

As such, it may be appreciated that there continues to be a need for a new and improved child's sink apparatus as set forth by the instant invention which addresses both the problems of ease of use as well as effectiveness in providing convenience of access and to enhance hygienic cleaning and oral maintenance of children and the like in a training and entertaining manner and in this respect, the present invention substantially fulfills this need.

SUMMARY OF THE INVENTION

In view of the foregoing disadvantages inherent in the known types of sink apparatus now present in the prior art, the present invention provides a child's sink apparatus wherein the same is arranged to provide a self-contained sink for use by children and the like to enhance entertainment and education of the child and proper hygienic patterns. As such, the general purpose of the present invention, which will be described subsequently in greater detail, is to provide a new and improved child's sink apparatus which has all the advantages of the prior art sink apparatus and none of the disadvantages.

To attain this, the present invention provides a cabinet structure including side walls, a floor, and a rear wall, and a top wall mounting a concave sink therewithin. The sink is operative through a manually operative pump and an underlying reservoir to direct fluid into the sink, with a drain associated with the sink directed into a further reservoir. A cylindrical cavity contains a series of nested cylindrical cups therewithin mounted for access in an inverted configuration. A modification of the invention includes a rear plate directed upwardly of a rear wall mounting a further reservoir, wherein the further reservoir includes a serpentine conduit, with the serpentine conduit directing metered fluid onto a simulated toothbrush member to effect oscillation of the toothbrush member, wherein the toothbrush member is biased by a spring to effect oscillation of the toothbrush upon fluid directed upon the toothbrush head.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child's sink apparatus which has all the advantages of the prior art sink apparatus and none of the disadvantages.

It is another object of the present invention to provide a new and improved child's sink apparatus which may be easily and efficiently manufactured and marketed.

It is a further object of the present invention to provide a new and improved child's sink apparatus which is of a durable and reliable construction.

An even further object of the present invention is to provide a new and improved child's sink apparatus which is susceptible of a low cost of manufacture with regard to both materials and labor, and which accordingly is then susceptible of low prices of sale to the consuming public, thereby making such child's sink apparatus economically available to the buying public.

Still yet another object of the present invention is to provide a new and improved child's sink apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic front view, taken in elevation, of the extended flange structure extending above the sink of the organization.

DESCRIPTION OF THE PREFERRED EMBODIMENT

Figure 1:
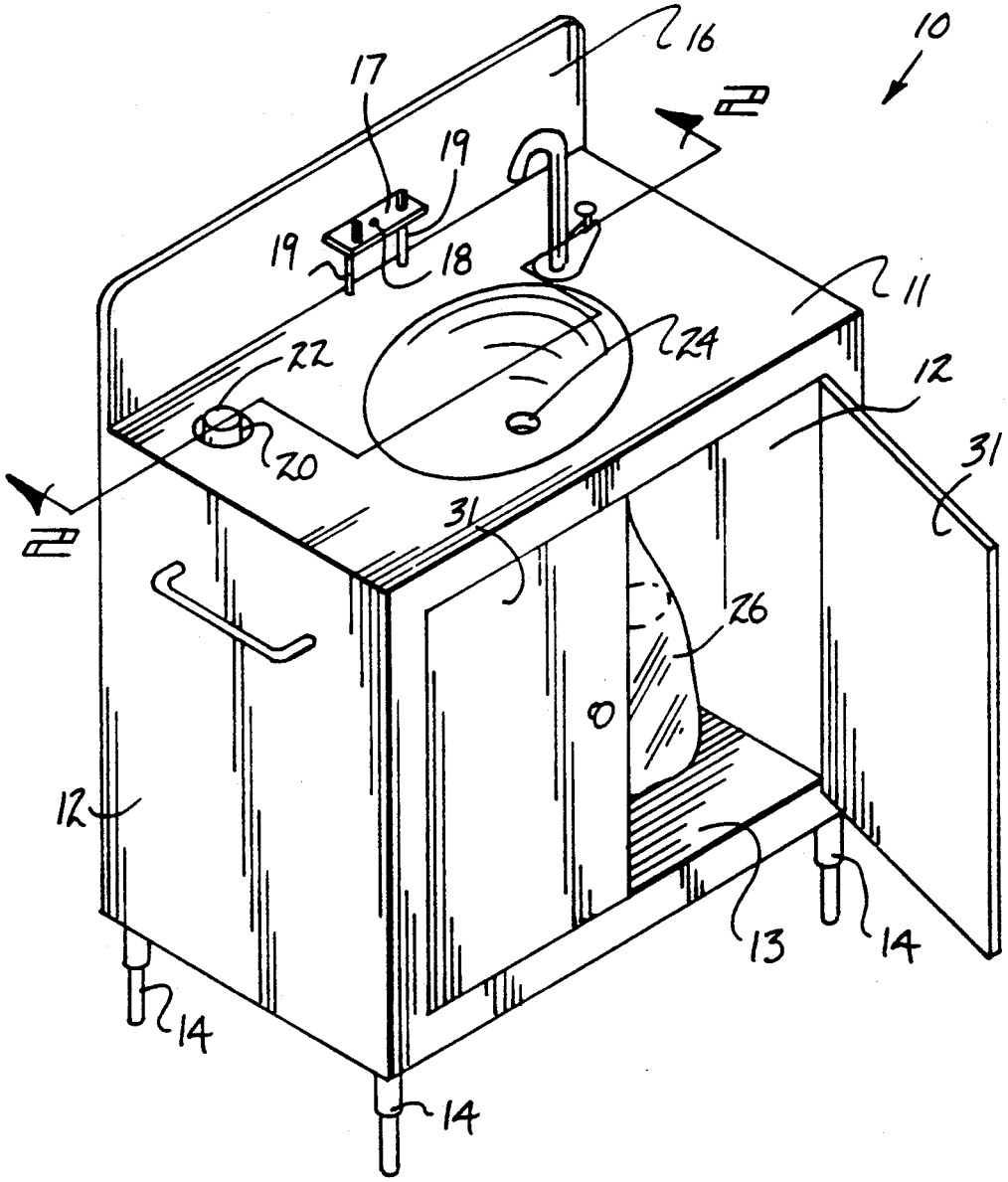
FIG. 1 is an isometric illustration of the instant invention.
Figure 2:
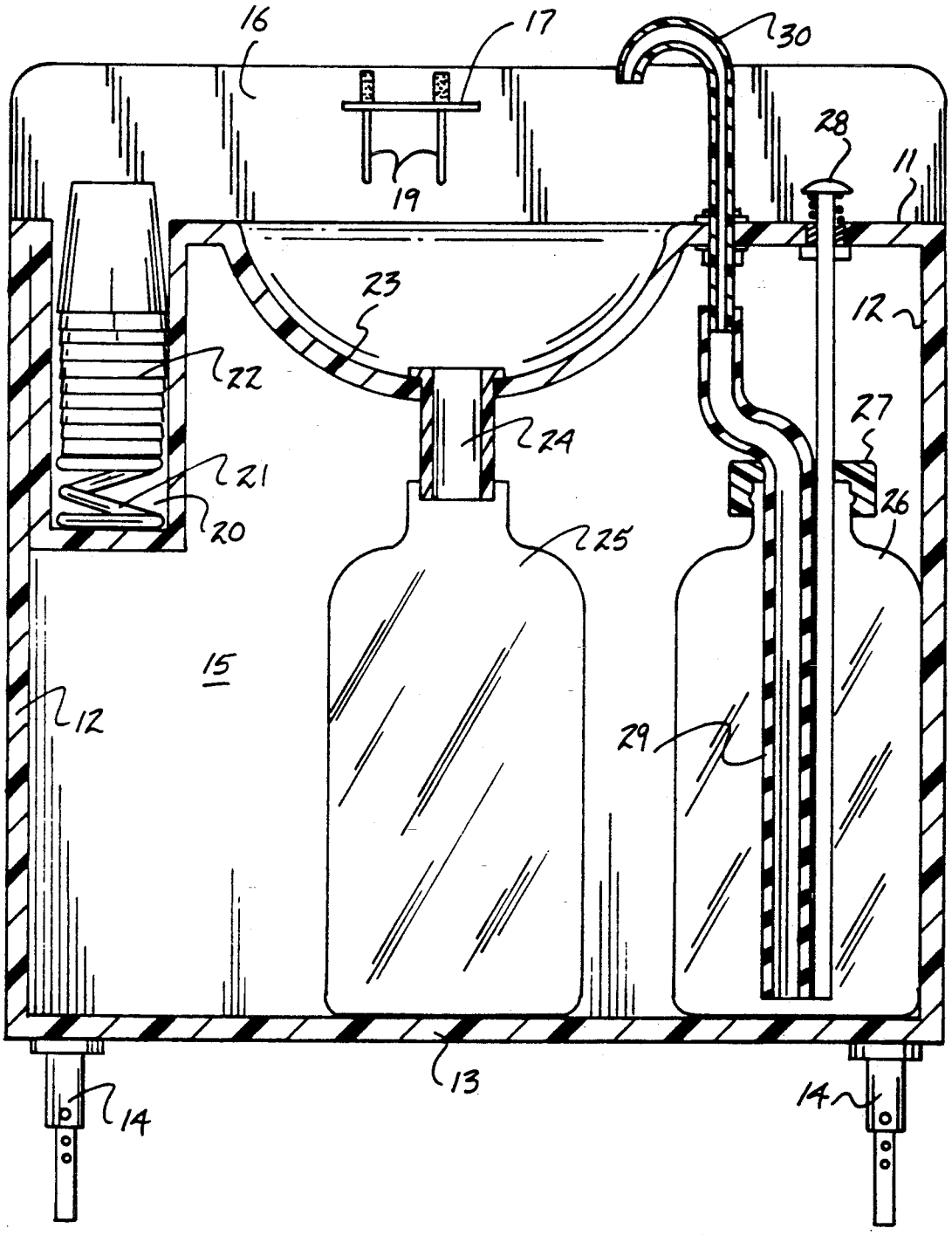
FIG. 2 is an orthographic side view of the instant invention, taken along the lines 2—2 of FIG. 1 in the direction indicated by the arrows.
Figure 3:
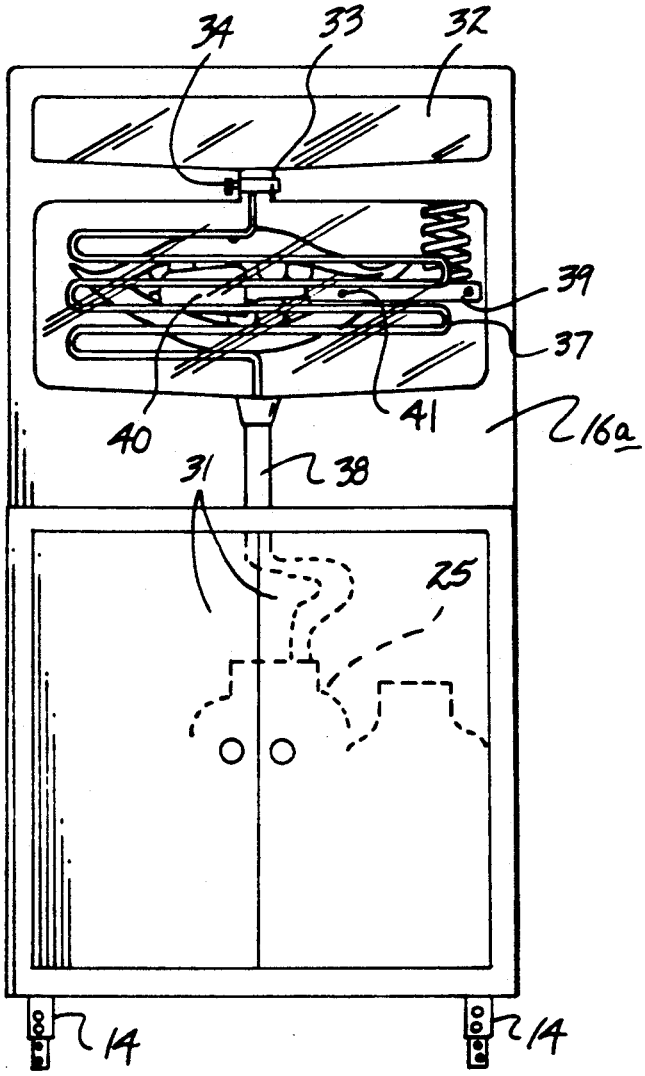
FIG. 3 is an orthographic front view, taken in elevation, of a modification of the instant invention.
Figure 4:
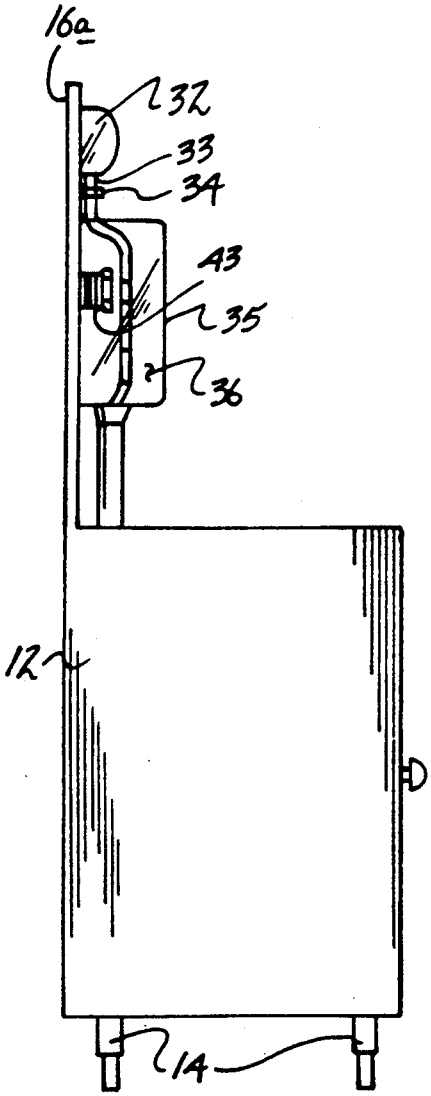
FIG. 4 is an orthographic side view, taken in elevation, of the modification of the instant invention.
Figure 5:
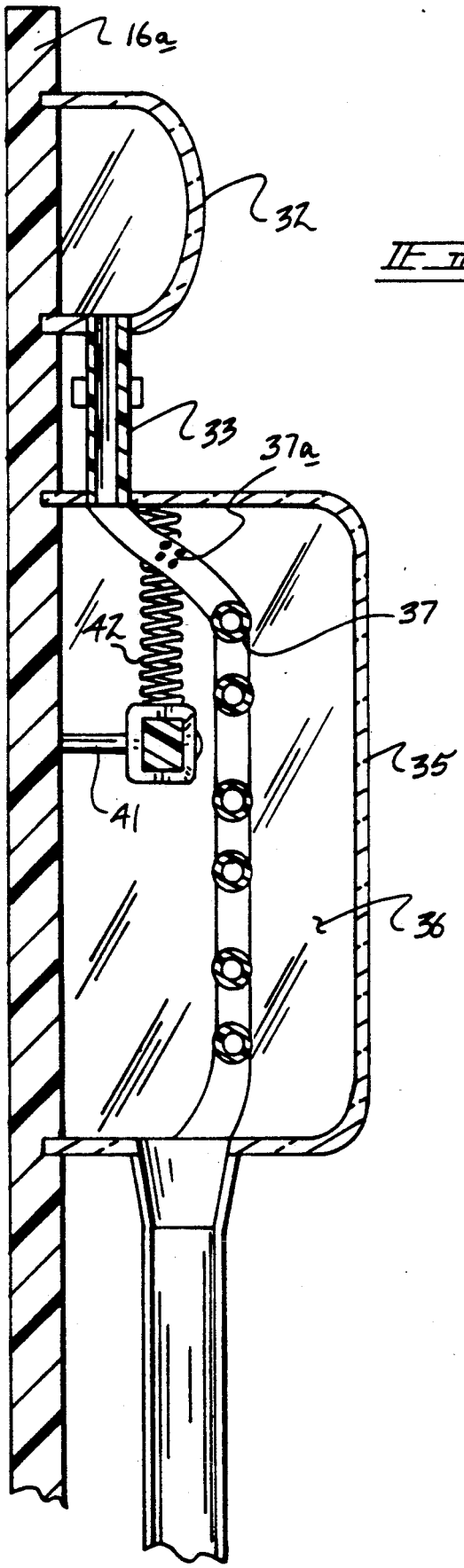
FIG. 5 is an orthographic cross-sectional side view, taken in elevation, of the instant invention of the extension flange extending above the sink structure.
Figure 11:
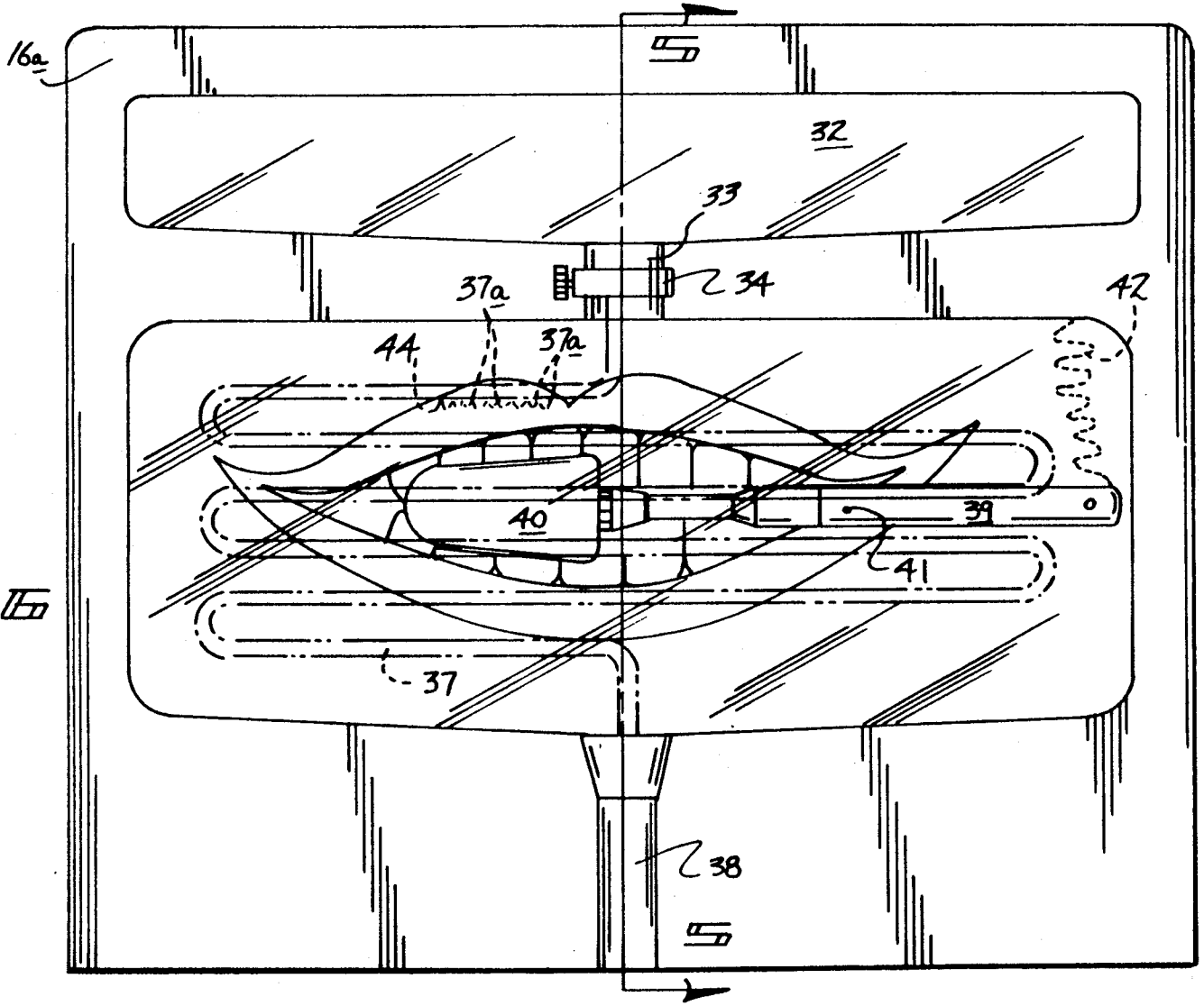

With reference now to the drawings, and in particular to FIGS. 1 to 6 thereof, a new and improved child's sink apparatus embodying the principles and concepts of the present invention and generally designated by the reference numerals 10 and 10*a* will be described.

More specifically, the child's sink apparatus 10 of the instant invention essentially comprises a cabinet housing, as illustrated for example in FIG. 1, that includes a top wall 11, spaced side walls 12, a floor 13 coextensively and arranged parallel underlying the top wall 11 with the floor 13 including an adjustable telescoping leg 14 mounted at each corner of the generally rectangular floor 13. A rear wall 15 is directed coextensively from the floor in communication with the side walls to the top wall 11, and includes a rear wall extension flange 16 extending orthogonally above the top surface of the top wall 11. A brush support plate 17 is orthogonally mounted medially of a forward surface of the rear wall 15 and includes a plurality of support apertures 18 directed therethrough with each aperture arranged for receiving a toothbrush member 19, as illustrated in FIG. 1. A cylindrical cup cavity 20 is directed orthogonally through and downwardly from the top wall 11 into the cabinet structure, and includes a cavity spring 21 receiving a nested stack of inverted cup members thereon to project the cup members for access by an individual to the top wall 11. A concave sink 23 is mounted within the top wall 11, and includes a sink drainage conduit 23 in communication with a first removable reservoir container 25. A second reservoir container 26 includes a reservoir cap 27 in sealing relationship relative to the upper terminal end of the second reservoir container, wherein pump means exemplified by a reciprocating plunger 28 orthogonally mounted through the top wall 11 is directed into the second reservoir container 26 through the cap 27 to effect a manual pumping of fluid contained therewithin. An output conduit lower section 29 is directed from within the second reservoir through the top wall 11 and terminates in a "J" shaped conduit upper section 30 positioned overlying the concave sink 23. A closure door 31 is hingedly mounted adjacent each side wall 12 permitting access interiorly of the cabinet for maintenance of the first and second reservoir containers therewithin.

A modification of the instant invention 10*a*, as illustrated in FIGS. 3–6, includes a modified extension flange 16*a* projecting above the top wall 11 in coextensive relationship with the rear wall 15. A third reservoir 32 is mounted adjacent an upper terminal end of the forward face of the extension flange 16*a* and positioned generally parallel relative to the top wall 11. The third reservoir 32 is transparent and contains a typically dyed fluid directed through a medially positioned output conduit 33 positioned to a bottom surface of the third reservoir 32, with the fluid selectively directed through an output conduit valve 34 formed within the output conduit 33. The output conduit 33 projects into a transparent cover 35 defining a cover cavity 36. A transparent serpentine lower conduit 37 receives fluid from the output conduit 33 and directs the colored fluid therethrough for amusement of a child and the like. The serpentine transparent lower conduit 37 includes a plurality of apertures 37*a* that are positioned through a first horizontal extent of the serpentine conduit 37 to emit in a metered fashion fluid flow 44 through the apertures 37*a*. A toothbrush handle 39, with a toothbrush head 40, is mounted upon a pivot axle 41 that is orthogonally directed through the toothbrush handle 39 into the forward surface of the modified extension flange 16*a*, with the toothbrush head 40 positioned immediately underlying the apertures 37*a* to receive the fluid flow 44 therefrom metered thereon through the valve 34. Fluid flow from the serpentine conduit 37 and from within the cover cavity 36 are directed through a second drainage conduit 38 that in turn is in fluid communication with the first reservoir container 25. A biasing spring 42 is mounted adjacent a rear terminal end of the handle to an upper edge thereof mounted between and opposed between a handle and a bottom surface of a horizontal extent of the transparent cover 35 overlying the toothbrush handle 39, whereupon the fluid flow 44 directed upon the toothbrush head 40 effects oscillation of the head and accordingly effects the bristle matrix 43 to simulate brushing of a simulated dental array in communication with a bristle matrix 43 to enhance amusement, entertainment, and understanding of a child as to proper dental hygiene.

Although not shown in the drawings it is evident that the extension 16*a* could be combined with the FIG. 1 counter top 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A child's sink apparatus, comprising, a cabinet including a top wall, spaced side walls, a floor underlying and coextensive with a top wall, and a rear wall extending from the floor to the top wall in orthogonal communication with rear edges of each of the side walls, with the top wall including a rear wall extension flange coextensive with the rear wall and orthogonally directed upwardly of the top wall, and a concave sink directed downwardly from the top wall, the concave sink including a drainage conduit, the drainage conduit in fluid communication with an underlying first removable reservoir conduit mounted within the cabinet upon the floor, and a second reservoir container, the second reservoir container including an output conduit directed from within the second reservoir container to the top wall, and a "J" shaped upper section conduit in fluid communication with the output conduit overlying the sink to direct fluid flow from the second reservoir container to the sink, and a cylindrical cup cavity directed orthogonally downwardly from the top wall, with the cup cavity including a cup cavity floor, the cup cavity floor including a spring mounted thereon, and a series of nested stacked inverted cup members mounted on the spring to bias the cup members to the top wall for access of the cup members by an individual, and a closure door hingedly mounted adjacent each side wall defining a forward wall of the cabinet coextensively between the top wall and the floor, and the rear wall extension flange includes a third reservoir container, the third reservoir container is transparent and includes a transparent output conduit, the output conduit including a valve member to effect selective flow from the reservoir container through the output conduit, and a transparent cover member, the transparent cover member receiving the output conduit, and defining a cover cavity therewithin defined between the transparent cover and a forward surface of the rear wall extension flange, and a serpentine transparent lower conduit in fluid communication with the third reservoir output conduit directing fluid flow from the third reservoir output conduit through the serpentine transparent lower conduit, and the transparent lower conduit including an uppermost horizontal extent, and the uppermost horizontal extent including a series of apertures directed therethrough to effect metered fluid flow through the apertures within the transparent cover cavity, and a toothbrush member pivotally mounted within the transparent cover cavity, the toothbrush member including a toothbrush handle, the toothbrush handle including a pivot axle directed through the toothbrush handle orthogonally mounted to the forward surface of the rear wall extension flange, and a biasing spring mounted between the pivot axle and a rear terminal end of the toothbrush handle, with the biasing spring mounted between the toothbrush handle and a bottom surface of an overlying horizontal extent of the transparent cover cavity, and the toothbrush member including a toothbrush head mounted on the toothbrush handle, the toothbrush head positioned in alignment and below the apertures to effect oscillation of the toothbrush member upon fluid flow directed through the output conduit and the apertures, and a bristle matrix mounted on a forward face of the toothbrush head, wherein the bristle matrix is in sliding communication with the forward surface of the rear wall extension flange.

* * * * *